US005810209A

United States Patent [19]

Foster

[11] Patent Number: 5,810,209

[45] Date of Patent: Sep. 22, 1998

[54] DISPENSER WITH IMPROVED BOTTLE CONNECTION

[75] Inventor: Donald D. Foster, St. Charles, Mo.

[73] Assignee: Continental Sprayers International, Inc., St. Peters, Mo.

[21] Appl. No.: 709,165

[22] Filed: Sep. 6, 1996

[51] Int. Cl.[6] ..... B67D 5/40; B04B 9/043; B65D 41/06

[52] U.S. Cl. ..... 222/383.1; 222/153.14; 222/324; 215/332; 239/333

[58] Field of Search ..... 222/153.14, 383.1, 222/153, 324; 215/332; 239/333

[56] References Cited

U.S. PATENT DOCUMENTS

| | | | |
|---|---|---|---|
| 3,656,645 | 4/1972 | Fontenelli . | |
| 3,667,636 | 6/1972 | Landen | 215/9 |
| 5,169,032 | 12/1992 | Steijns et al. . | |
| 5,169,033 | 12/1992 | Shay . | |
| 5,238,152 | 8/1993 | Maas et al. . | |
| 5,257,724 | 11/1993 | Steijns . | |
| 5,297,701 | 3/1994 | Steijns et al. . | |
| 5,318,206 | 6/1994 | Maas et al. . | |
| 5,373,973 | 12/1994 | Foster | 222/324 |
| 5,379,926 | 1/1995 | Mueller et al. | 222/507 |
| 5,449,078 | 9/1995 | Akers . | |
| 5,551,582 | 9/1996 | Robinson . | |

FOREIGN PATENT DOCUMENTS

| | | | |
|---|---|---|---|
| 0705000 | 4/1984 | European Pat. Off. | 239/333 |
| 0202380 | 11/1986 | European Pat. Off. | 239/333 |

*Primary Examiner*—Andres Kashnikow
*Assistant Examiner*—Keats Quinalty
*Attorney, Agent, or Firm*—Howell & Haferkamp, L.C.

[57] ABSTRACT

A dispenser comprises a container for containing fluid to be dispensed and a manually operated reciprocating fluid pump adapted to be secured to the container. The fluid pump includes a pump mechanism, an intake port adapted for fluid communication with liquid contained in the container, an intake liquid flow path providing fluid communication between the intake port and the pump mechanism, a discharge port, a discharge liquid flow path providing fluid communication between the pump mechanism and discharge port, and a closure cap portion configured for connection to the container. The closure cap portion comprising a generally annular-shaped skirt, a lug extending generally radially inwardly from an inside surface of the skirt, and an aperture in the skirt and circumferentially spaced from the lug. The container includes a neck having a mouth therein for passage therethrough of liquid in the container. The container further includes a bayonet provision on an outer surface of the neck for matably receiving the lug of the closure cap portion, and a radially extending tab configured for extending into the aperture of the skirt. The lug is shaped and configured to mate with the bayonet provision and the tab is shaped and configured to mate with the aperture when the skirt of the closure cap portion is positioned on the neck of the container to releasably lock the closure cap portion to the neck of the container.

20 Claims, 3 Drawing Sheets

DISPENSER WITH IMPROVED BOTTLE CONNECTION

BACKGROUND OF THE INVENTION

This invention relates to manually-operated reciprocating fluid pumps such as pump-type trigger sprayers.

A trigger sprayer typically includes a dispenser body, a closure cap connected to the dispenser body for securing the trigger sprayer to the neck of a container (or bottle), a dip tube depending from the dispenser body and configured for extending through a mouth (i.e., opening) in the neck of the bottle, and a gasket (or bottle seal) for preventing leakage between the closure cap and the mouth of the container when the closure cap closes the mouth of the container.

The dispenser body has a manually operated pump which draws liquid up the dip tube from the bottle and dispenses it through a nozzle via a liquid flow path in the dispenser body. A priming check valve within the liquid flow path and upstream of the pump permits fluid flow from the container to the pump, but checks fluid flow from the pump back to the container. Another check valve within the liquid flow path and downstream of the pump permits fluid flow from the pump to the nozzle, but checks fluid flow from the nozzle to the pump.

A concern associated with such a trigger sprayer is the cost of manufacture. A typical trigger sprayer is of relatively low cost. However, trigger sprayers with more pieces generally cost slightly more to produce than trigger sprayers with fewer pieces. Millions of trigger sprayers are sold each year for use in dispensing a wide variety of products. Because of the large volumes sold, a savings of even one cent per trigger sprayer is significant.

To reduce the number of trigger sprayer pieces, the closure cap and bottle seal of some conventional trigger sprayers are molded as monolithic (integral) portions of a housing of the trigger sprayer and are made of the same rigid material as the sprayer housing. Because the integral closure cap cannot rotate relative to the trigger sprayer housing, the skirt of the cap does not have a threaded inner surface for engaging a thread on the neck of the bottle. Rather, two diametrically opposite lugs extend radially inwardly from the skirt of the cap and are configured for a snap fit engagement with two diametrically opposite bayonet provisions on the neck of the bottle. The bottle seal of such sprayer is shaped to sealingly engage an inner surface (e.g., inner circumference) of the mouth of the bottle.

A concern with such bayonet-type bottle connection is that the closure cap tends to rock on the bayonet provisions of the bottle. This rocking may result in the bottle seal becoming unsealed from the mouth of the bottle thereby allowing inadvertent leakage of the liquid contents of the bottle between the bottle seal and bottle.

SUMMARY OF THE INVENTION

Among the several objects of the present invention may be noted the provision of an improved fluid pump; the provision of such a fluid pump which has a minimum number of parts; the provision of such a fluid pump which is relatively low in cost; the provision of such a trigger sprayer having a bottle seal and closure cap of a monolithic construction; the provision of such a trigger sprayer and bottle having a releasable connection configured for minimizing rocking of the closure cap relative to the bottle and for minimizing fluid leakage between the closure cap and bottle; and the provision of such a fluid pump which is of relatively simple construction.

Generally, a dispenser of the present invention comprises a container for containing fluid to be dispensed and a manually operated reciprocating fluid pump adapted to be secured to the container. The fluid pump includes a pump mechanism, an intake port adapted for fluid communication with liquid contained in the container, an intake liquid flow path providing fluid communication between the intake port and the pump mechanism, a discharge port, a discharge liquid flow path providing fluid communication between the pump mechanism and discharge port, a closure cap portion configured for releasably securing the fluid pump to the container, and a seal portion engageable with the container and shaped and configured for providing a fluid-tight seal between the fluid pump and the container. The closure cap portion comprising a generally annular-shaped skirt, at least one lug extending generally radially inwardly from an inside surface of the skirt, and at least one aperture in the skirt and circumferentially spaced from the lug. The container includes a neck having a mouth therein for passage therethrough of liquid in the container. The container further includes at least one bayonet provision on an outer surface of the neck for matably receiving the lug of the closure cap portion, and at least one radially extending tab configured for extending into the aperture of the skirt. The lug is shaped and configured to mate with the bayonet provision and the tab is shaped and configured to mate with the aperture when the skirt of the closure cap portion is positioned on the neck of the container to releasably lock the closure cap portion to the neck of the container.

In another aspect of the present invention, a manually operated reciprocating fluid pump is configured for connection to a fluid container including a neck having a mouth therein for passage therethrough of liquid in the container, at least two bayonet provisions on an outer surface of the neck, and at least two radially extending tabs. The fluid pump comprises a pump mechanism, an intake port adapted for fluid communication with liquid contained in the container, an intake liquid flow path providing fluid communication between the intake port and the pump mechanism, a discharge port, a discharge liquid flow path providing fluid communication between the pump mechanism and discharge port, a closure cap portion, and a seal portion. The closure cap portion is configured for releasably securing the fluid pump to the container. The seal portion is engageable with the container and is shaped and configured for providing a fluid-tight seal between the fluid pump and the container. The closure cap portion comprising a generally annular-shaped skirt, at least two lugs extending generally radially inwardly from an inside surface of the skirt and configured to mate with the bayonet provisions of the container when the closure cap portion is positioned on the neck of the container, and at least two apertures in the skirt and circumferentially spaced from the lugs and shaped for receiving the tabs of the container when the closure cap portion is positioned on the neck of the container.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
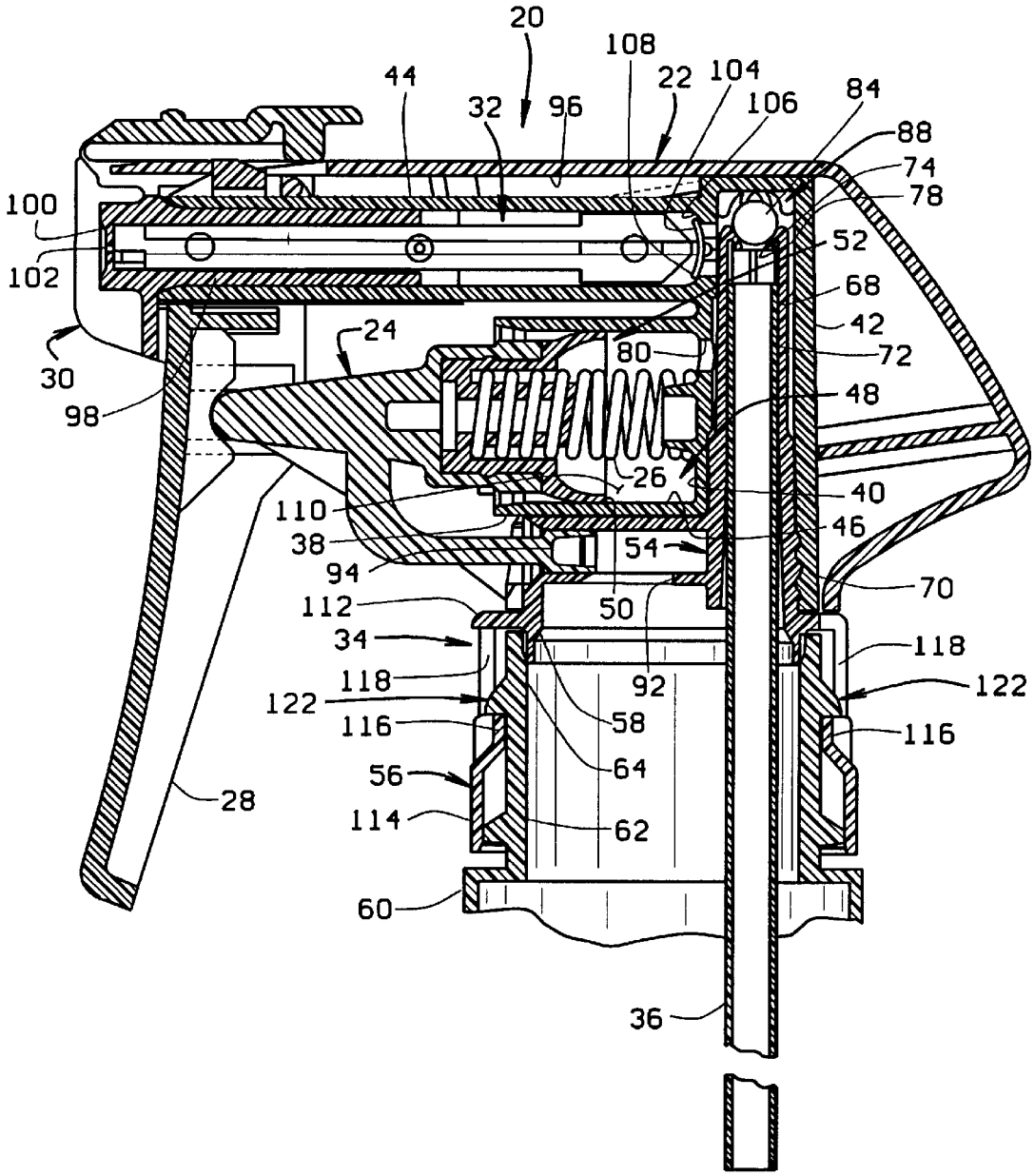
FIG. 1 is a fragmented side elevational view, in section, of a trigger sprayer and bottle (container) of the present invention.
Figure 4:
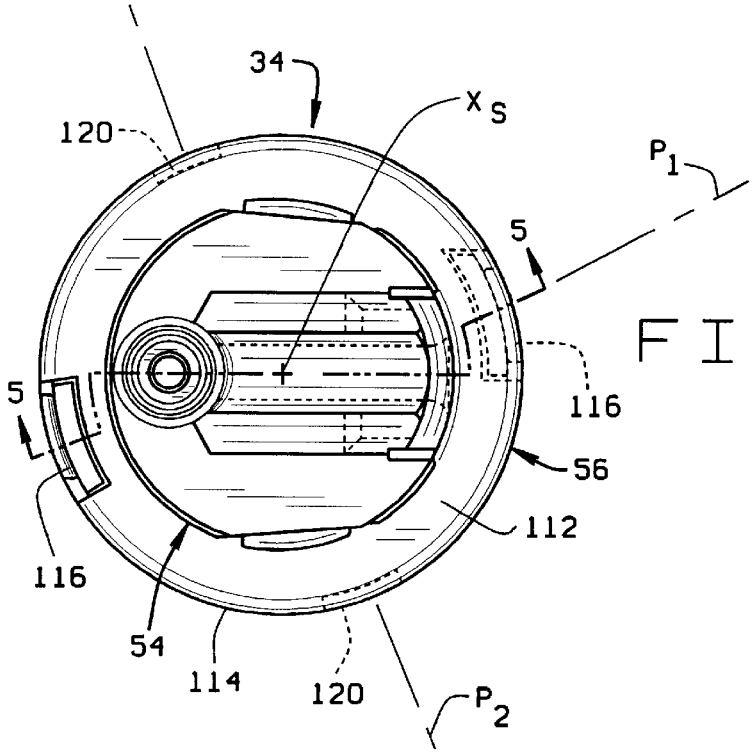
FIG. 4 is a top plan view of the lower member of FIG. 2.
Figure 3:
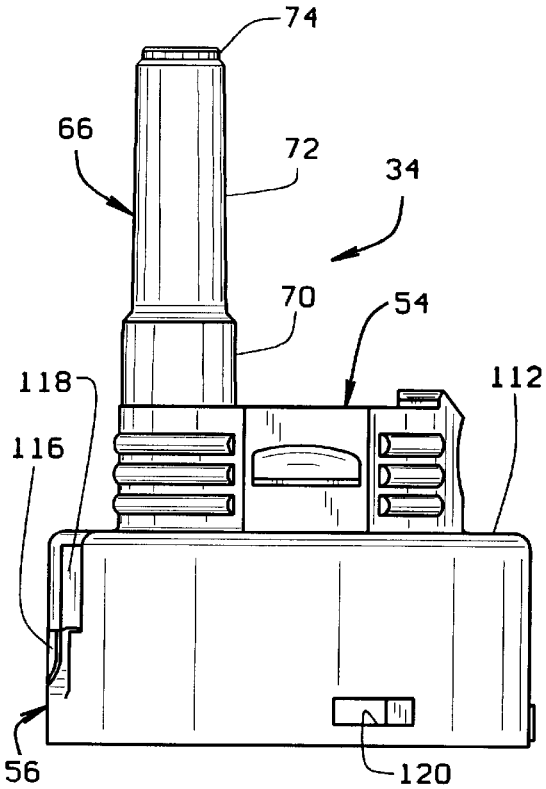
FIG. 3 is a side elevational view of the lower member of FIG. 2.
Figure 2:
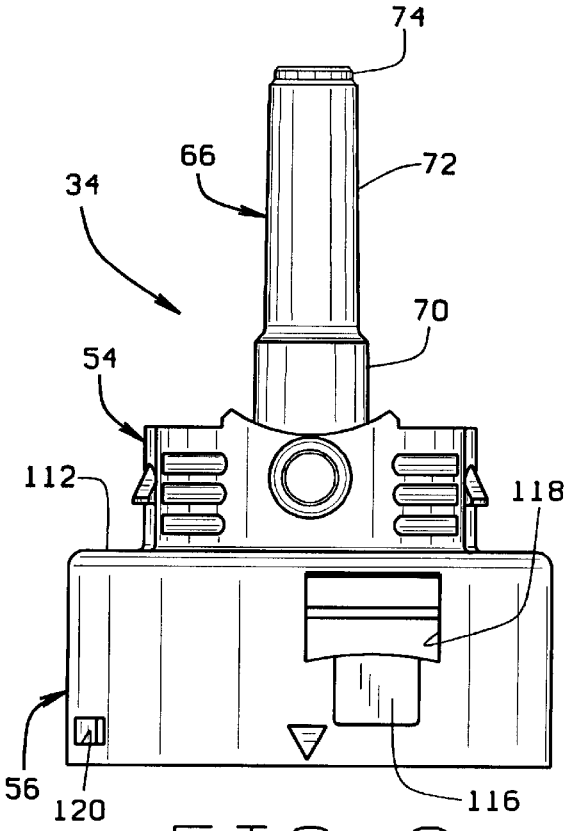
FIG. 2 is a front elevational view of a lower member of the trigger sprayer of FIG. 1.
Figure 5:
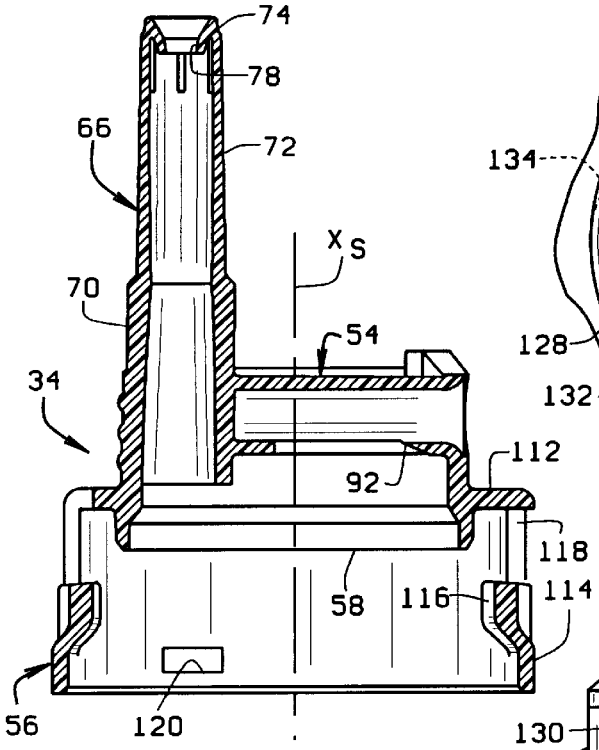
FIG. 5 is a section view taken along the plane of line 5—5 of FIG. 4.

Referring now to the drawings, and first more particularly to FIG. 1, a trigger sprayer of the present invention is indicated in its entirety by the reference numeral 20. Preferably, the trigger sprayer 20 includes: (1) an upper housing member, generally indicated at 22; (2) a plunger, generally indicated at 24, (3) a coil spring 26; (4) a trigger 28; (5) a nozzle assembly, generally indicated at 30; (6) a spinner assembly, generally indicated at 32; (7) a lower member, generally indicated at 34; and (8) a dip tube 36. The upper housing member 22 and plunger 24 constitute a dispenser body.

The upper housing member 22 is preferably a single unitary piece and includes a cylindric wall 38, a circular back wall 40 substantially closing one end (i.e., the right end as viewed in FIG. 1) of the cylindric wall, a generally cylindric vertical formation 42 adjacent the circular back wall, and a horizontal tubular portion 44 extending forward from the vertical formation. The cylindric wall 38 includes a generally cylindric inner surface 46. The cylindric inner surface 46 of the cylindric wall 38 and the circular back wall 40 define a pump chamber, generally indicated at 48 open at one end (i.e., its left end as viewed in FIG. 1) for slidably receiving a piston head 50 of the plunger 24. The pump chamber 48, piston head 50, and spring 26 constitute components of a pump mechanism, generally indicated at 52.

The lower member 34 is a molded, monolithic member and includes a lower housing portion 54, a closure cap portion 56, and a seal portion 58. The lower housing portion 54, closure cap portion 56, and seal portion 58 are a single monolithic piece and are preferably made of a suitable polymeric material such as polypropylene. The closure cap portion 56 is shaped for connection to a container, such as a bottle 60 having a neck 62 and a mouth 64 in the neck for passage therethrough of liquid in the bottle. The closure cap portion 56 and bottle neck 62 is discussed in greater detail below. The seal portion 58 preferably has the shape of an annular lip sized for extending into the bottle mouth 64 and for sealingly engaging the inner circumference of the bottle neck 62.

The lower housing portion 54 includes a tubular portion 66 extending upwardly into a vertical bore 68 of the vertical formation 42 of the upper housing member 22. Preferably, the tubular portion 66 has a lower region 70, an intermediate region 72, and an upper region 74. The lower region 70 of the lower housing tubular portion 66 is sized for a snug fit in the vertical bore 68 of the vertical formation 42 to provide a fluid tight seal therebetween. The intermediate region 72 has an outer diameter which is less than the inner diameter of the housing vertical bore 68. The outer surface of the intermediate region 72 and the surface of the housing vertical bore 68 define an annular fluid passage therebetween. Preferably, the inside diameter of the lower and intermediate regions 70, 72 of the lower member tubular portion 66 are sized for a snug fit of the upper portion of the dip tube 36.

The upper region 74 of the lower member tubular portion 66 includes a check-valve seat 78. The check-valve seat 78 defines an intake port (also referred to by reference number 78) of the trigger sprayer 20. The intake port 78 is in fluid communication with liquid (not shown) contained in the bottle 60 via the dip tube 36.

The upper housing member 22 further includes a lateral opening 80 extending through its circular back wall 40. Preferably, the lateral opening 80 is aligned with the intermediate region 72 of the lower member tubular portion 66 for providing fluid communication between the pump chamber 48 and the annular fluid passage. The upper region 74 of the lower member tubular portion 66, the annular fluid passage, and the lateral opening 80 define an intake liquid flow path providing fluid communication between the intake port 78 and the pump mechanism 52.

The check-valve seat 78 is shaped and configured for receiving a ball 84. The check-valve seat 78 and ball 84 constitute a priming check valve 88 in the intake liquid flow path for permitting fluid flow from the intake port 78 to the pump mechanism 52 and for checking fluid flow from the pump mechanism to the intake port. The ball 84 constitutes a moveable valve member of the priming check valve 88.

The plunger 24 further includes a plug 94 integrally connected to and moveable with the piston head 50. The plug 94 is adapted for closing a bottle vent opening 92 through the closure cap portion 56 of the lower member 34 when the trigger sprayer 20 is not in use, to prevent liquid from spilling out of the bottle via the opening.

The horizontal tubular portion 44 of the upper housing member 22 includes a horizontal bore 96 extending horizontally between a rear portion and a forward end (left end as viewed in FIG. 1) of the upper housing member. The nozzle assembly 30 includes a tubular projection 98 inserted into the horizontal bore 96 via the forward (downstream) end of the bore, a nozzle wall 100 at a forward end of the nozzle tubular projection, and a nozzle orifice 102 through the nozzle wall and in fluid communication with the interior of the bore. The annular fluid passage, the horizontal bore 96, and the interior of the nozzle tubular projection 98 constitute a discharge liquid flow path. The nozzle orifice 102 constitutes a discharge port (also referred to via reference numeral 102) of the discharge liquid flow path. Dispensed liquid flows from the pump chamber 48, through the lateral opening 80, upward through the annular fluid passage, forward through the horizontal bore 96, and then out through the discharge port 102.

The spinner assembly 32 is positioned in the upper housing member's horizontal bore 96 and is held in place by the nozzle tubular projection 98. The spinner assembly 32 includes a resilient disc 104 at its rearward end (right end as viewed in FIG. 1). The resilient disc 104 is engageable with an annular shoulder 106 formed in the upper housing member 22 at the rear end of the horizontal bore 96. The resilient disc 104 and the annular shoulder 106 constitute a discharge check valve, generally indicated at 108, in the discharge liquid flow path for permitting fluid flow from the pump mechanism 52 to the nozzle discharge port 102 and for checking fluid flow from the discharge port 102 to the pump mechanism. In particular, the resilient disc 104 of the spinner assembly 32 constitutes a moveable valve member of the discharge check valve 108 and the annular shoulder 106 of the upper housing member 22 constitutes a valve seat of the discharge check valve. The resilient disc 104 is moveable between a closed position and an open position. In its closed (or seated) position, the resilient disc 104 sealing engages the annular shoulder 106 all around the shoulder to prevent passage of liquid therethrough. In its open (unseated) position, at least a part of the resilient disc 104 flexes forwardly away from the annular shoulder 106 to thereby provide a gap between the resilient disc and the shoulder to allow liquid to flow therethrough.

The piston head 50 of the plunger 24 is preferably formed of a suitable resilient material such as low density polyethylene. The piston head 50 comprises the rearward end (the right most end as viewed in FIG. 1) of the plunger 24. The piston head 50 is slidable within the pump chamber 48 and configured for sealing engagement with the cylindric inner surface 46 of the pump chamber 48 all around the piston head 50 to seal against leakage of fluid between the plunger 24 and cylindric inner surface 46 of the upper housing member 22. The piston head 50 and pump chamber 48 define a variable volume fluid receiving cavity 110. The piston head 50 is reciprocally slidable in the pump chamber 48 between a forward (extended) position and a rearward (compressed) position. The plunger 24 is manually moved from its extended position to its compressed position by depressing the trigger 28. The coil spring 26 is positioned between the circular back wall 40 of the pump chamber 48 and the plunger 24 for urging the plunger forward to its extended position. Thus, the plunger 24 is rearwardly moved from its extended position to its compressed position by manually squeezing the trigger 28, and is automatically returned to its extended position via the coil spring 26 when the operator releases the trigger.

Referring now to FIGS. 2–5, the closure cap portion 56 includes a disc-shaped portion 112 and an annular skirt 114 circumscribing and depending down from the disc-shaped portion. The annular skirt 114 has a central skirt axis $X_s$ which is preferably concentric to the annular skirt and generally perpendicular to the disc-shaped portion 112. The annular skirt 114 is sized and configured for engaging the outer surface of the neck 62 of the bottle 60. The seal portion 58 depends downwardly from the disc-shaped portion 112. It is circumscribed by, generally coaxial with, and spaced radially inwardly of the annular skirt 114. The seal portion 58 is shaped for sealingly engaging the inner surface of the bottle's neck 62 all around such inner surface when the skirt is secured to the outer surface of the bottle's neck.

Preferably, first and second lugs 116 extend generally radially inwardly from an inner surface of the skirt 114. The lugs 116 are circumferentially spaced along the inside surface of the skirt 114, and preferably extend radially inwardly from generally diametrically opposite portions of the skirt. The lugs 116 are positioned generally below a like number of openings or windows 118 through the annular skirt 114 for extraction of mold parts during the molding process of the lower member 34. The annular skirt 114 also includes first and second through apertures 120. The apertures 120 are circumferentially spaced from each other along the inside surface of the skirt 114, and are preferably diametrically opposite one another. The lugs and apertures are preferably located such that a first plane $P_1$ (FIG. 4) parallel to the skirt axis $X_s$ and intersecting the first and second lugs 116 is generally perpendicular to a second plane $P_2$ parallel to the skirt axis and intersecting the first and second apertures 120. More preferably, the first and second planes $P_1$, $P_2$, intersect generally at the skirt axis $X_s$. In other words, each aperture 120 is circumferentially spaced from each lug 116 and is preferably located generally equidistant from each lug 116.

Figure 6:
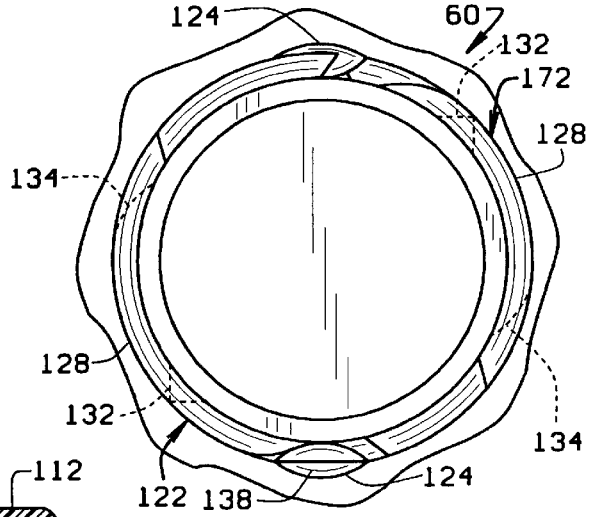
FIG. 6 is a fragmented top plan view of the bottle finish of the bottle of FIG. 1.
Figure 7:
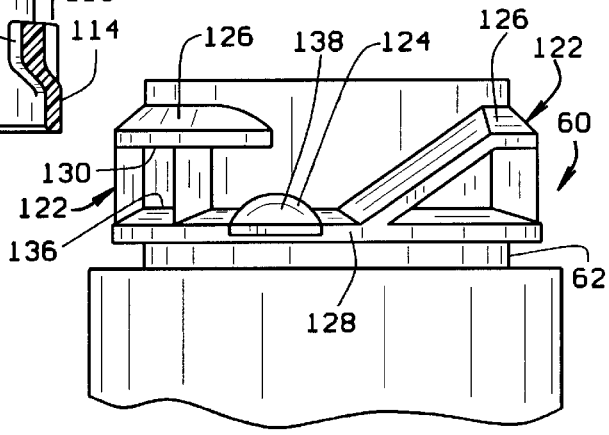
FIG. 7 is a fragmented side elevational view of the bottle finish of FIG. 6.
Figure 9:
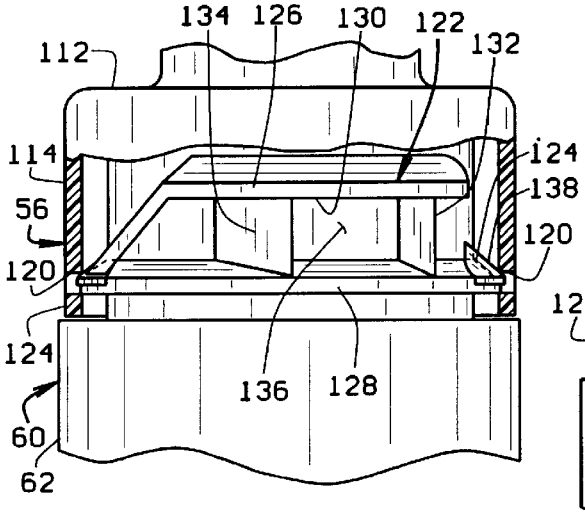
FIG. 9 is a fragmented front elevational view showing the lower member of FIGS. 2–5 attached to the bottle finish of FIGS. 6–8, and with portions of the lower member broken away to show detail.
Figure 8:
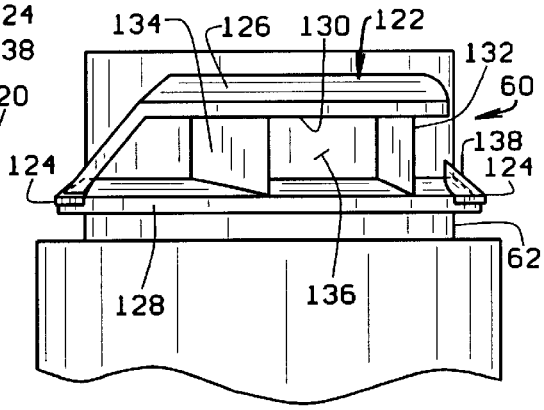
FIG. 8 is a fragmented front elevational view of the bottle finish of FIG. 6.

Referring now to FIGS. 6–8, the bottle 60 includes at least one and preferably two bayonet provisions, generally indicated at 122, on the outer surface of the bottle's neck 62. The bayonet provisions 122 are shaped and configured for matably receiving the lugs 116 of the closure cap portion 56. The bottle 60 also includes at least one and preferably two tabs 124 extending radially outwardly from the bottle's neck 62. The tabs 124 are sized and shaped for extending into the first and second apertures 120 of the annular skirt 114.

Preferably, the bayonet provisions 122 are circumferentially spaced and generally diametrically opposite one another. The bayonet provisions 122 are shaped and configured to mate with the lugs 116 to releasably lock the skirt 114 of the closure cap portion 56 to the bottle's neck 62. Each bayonet provision 122 includes upper (first) and lower (second) arcuate rib portions 126, 128 which are generally vertically spaced to define a lug-receiving channel 130 therebetween. First and second vertical rib portions 132, 134 extend between the upper and lower arcuate rib portions 126, 128 of the provisions and are circumferentially spaced to define a lug holding recess 136 (FIG. 8) of the lug-receiving channel 130. The rib portions 126, 128, 132, 134 are configured to engage the lugs 116 of the closure cap portion 56 when the lugs are received in the lug holding recesses 136 to thereby resist circumferential and vertical movement of the closure cap portion relative to the bottle's neck 62.

Each tab 124 includes a camming surface (or ramp) 138. The ramps 138 are shaped and configured to push against the inner surface of the annular skirt 114 as the skirt is pushed downwardly around both the neck of the container and the tabs 124 to cause the skirt to flex radially outwardly. The skirt 114 and tabs 124 are shaped and configured for a resilient snap-fit engagement of the tabs 124 in the apertures 120 when the apertures are brought into alignment with the tabs. Interengagement of the tabs 124 and apertures 120 resist vertical movement of the closure cap portion 56 relative to the bottle's neck 62. Thus, this interengagement, coupled with the interconnection of the lugs 116 and bayonet provisions 122, limits rocking of the closure cap and maintains a tight seal between the seal portion 56 and the bottle 60.

Because of the bayonet provisions 122, the lugs 116, the tabs 124 and the apertures 120, the closure cap portion 56 can be snap fit onto the bottle's neck 62 in one of two ways. In the first way, the closure cap portion 56 is merely pressed downwardly onto the bottle's neck 62. The upper arcuate rib portions 126 preferably have inclined (i.e., wedge shaped) upper surfaces. When the closure cap portion 56 is pressed downwardly onto the bottle's neck 62, the lugs 116 press against the inclined upper surfaces of the upper rib portions 126 to force the upper rib portions radially inwardly until the lugs move downwardly into the lug holding recesses 136. The upper rib portions 126 then snap back into their original position and help retain the lugs 116 in the lug holding recesses 136 Alternatively, the lugs 116 are aligned with gaps between adjacent upper rib portions 126 and the closure cap portion 56 is moved downwardly on the bottle's neck 62 until the lugs are in the lug receiving channels 130. The closure cap portion 56 is then rotated about 90° until the lugs 116 are positioned laterally between the first and second vertical rib portions 132, 134. The vertical rib portions 132, 134 resist rotational movement of the closure cap portion 56 relative to the bottle 60 and the arcuate rib portions 126, 128 resist vertical movement of the closure cap portion relative to the bottle. In either case, the tabs 124 snap into engagement with the apertures 120 when the apertures are brought into alignment with the tabs.

Because the closure cap portion 56 has both the lug/bayonet provision engagement and the tab/aperture engagement, the closure cap portion resists rocking and maintains the seal portion 58 in sealing engagement with the bottle.

Although the preferred embodiment has been described as a trigger sprayer, it is to be understood that other pump-type dispensers (e.g., lotion dispensers, etc.) are also encompassed by this invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A dispenser comprising:

a container for containing fluid to be dispensed; and a manually operated reciprocating fluid pump adapted to be secured to the container;

the fluid pump including a pump mechanism, an intake port adapted for fluid communication with liquid contained in the container, an intake liquid flow path providing fluid communication between the intake port and the pump mechanism, a discharge port, a discharge liquid flow path providing fluid communication between the pump mechanism and discharge port, a closure cap portion configured for releasably securing the fluid pump to the container, and a seal portion engageable with the container and shaped and configured for providing a fluid-tight seal between the fluid pump and the container;

the closure cap portion comprising a generally annular-shaped skirt, at least one lug extending generally radially inwardly from an inside surface of the skirt, and at least one aperture in the skirt and circumferentially spaced from the lug;

the container including a neck having a mouth therein for passage therethrough of liquid in the container, the container further including at least one bayonet provision on an outer surface of the neck for matably receiving said at least one lug of the closure cap portion, and at least one radially extending tab configured for extending into said at least one aperture of the skirt;

said at least one lug being shaped and configured to mate with said at least one bayonet provision and said at least one tab being shaped and configured to mate with said aperture when the skirt of the closure cap portion is positioned on the neck of the container to releasably lock the closure cap portion to the neck of the container.

2. A dispenser as set forth in claim 1 wherein said at least one lug comprises first and second lugs extending generally radially inwardly from the inside surface of the skirt, and wherein said at least one bayonet provision comprises first and second bayonet provisions on the outer surface of the neck for matably receiving the first and second lugs.

3. A dispenser as set forth in claim 2 wherein said first and second lugs are circumferentially spaced along the inside surface of the skirt, and wherein said first and second bayonet provisions are circumferentially spaced along the outer surface of the neck.

4. A dispenser as set forth in claim 3 wherein said lugs extend radially inwardly from generally diametrically opposite portions of the skirt.

5. A dispenser as set forth in claim 1 wherein said at least one tab extends radially outwardly.

6. A dispenser as set forth in claim 5 wherein the skirt is configured to flex radially outwardly as the skirt is placed around both the neck of the container and said tab, the skirt being configured for a resilient snap-fit engagement of said tab in said aperture when said aperture is in alignment with said tab.

7. A dispenser as set forth in claim 1 wherein the bayonet provision and said lug is configured for a snap-fit engagement of said lug in said bayonet provision.

8. A dispenser as set forth in claim 7 wherein the bayonet provision includes first and second arcuate rib portions which are generally vertically spaced to define a lug-receiving channel therebetween.

9. A dispenser as set forth in claim 8 wherein the bayonet provision further includes first and second vertical rib portions extending between the first and second arcuate rib portions and being circumferentially spaced to define a lug holding recess of the lug-receiving channel, said arcuate and vertical rib portions being configured to engage said lug when said lug is received in the lug holding recess to thereby resist circumferential and vertical movement of the closure cap portion relative to the neck of the container.

10. A dispenser as set forth in claim 1 wherein the skirt of the closure cap portion circumscribes and is spaced radially from the seal portion, the seal portion having an annular outer surface sized and configured for sealingly engaging an inner annular surface of the neck of the container all around the seal portion's annular outer surface when the closure cap portion is locked to the neck of the bottle.

11. A fluid pump as set forth in claim 10 wherein the seal portion and closure cap portion are of a molded one piece construction.

12. A dispenser comprising:

a container for containing fluid to be dispensed; and a manually operated reciprocating fluid pump adapted to be secured to the container;

the fluid pump including a pump mechanism, an intake port adapted for fluid communication with liquid contained in the container, an intake liquid flow path providing fluid communication between the intake port and the pump mechanism, a discharge port, a discharge liquid flow path providing fluid communication between the pump mechanism and discharge port, a closure cap portion configured for releasably securing the fluid pump to the container, and a seal portion engageable with the container and shaped and configured for providing a fluid-tight seal between the fluid pump and the container;

the closure cap portion comprising a generally annular-shaped skirt, at least two lugs extending generally radially inwardly from an inside surface of the skirt, and at least two apertures in the skirt and circumferentially spaced from the lugs;

the container including a neck having a mouth therein for passage therethrough of liquid in the container, the container further including at least two bayonet provisions on an outer surface of the neck for matably receiving said at least two lugs of the closure cap portion, and at least two radially extending tabs configured for extending into said apertures of the skirt;

said lugs being shaped and configured to mate with said bayonet provisions and said tabs being shaped and configured to mate with said apertures when the skirt of the closure cap portion is positioned on the neck of the container to releasably lock the closure cap portion to the neck of the container.

13. A dispenser as set forth in claim 12 wherein:

the skirt has a central skirt axis;

said at least two lugs comprise first and second lugs circumferentially spaced on the skirt and extending generally radially inwardly from the inside surface of the skirt;

said at least two apertures comprise first and second apertures circumferentially spaced on the skirt; and said lugs and apertures being positioned such that a first plane parallel to the skirt axis and intersecting the first and second lugs is generally perpendicular to a second plane parallel to the skirt axis and intersecting the first and second apertures.

14. A dispenser as set forth in claim 13 wherein said first and second lugs extend radially inwardly from generally diametrically opposite portions of the skirt.

15. A dispenser as set forth in claim 14 wherein said first and second apertures are in generally diametrically opposite portions of the skirt.

16. A dispenser as set forth in claim 13 wherein said tabs extend radially outwardly.

17. A dispenser as set forth in claim 16 wherein the skirt is configured to flex radially outwardly as the skirt is placed around the neck of the container and said tabs, the skirt being configured for a resilient snap-fit engagement of said tabs in said apertures when said apertures are in alignment with said tabs.

18. A dispenser as set forth in claim 17 wherein the bayonet provisions and said lugs are configured for a snap-fit engagement of said lugs in said bayonet provisions.

19. A manually operated reciprocating fluid pump configured for connection to a fluid container including a neck having a mouth therein for passage therethrough of liquid in the container, at least two bayonet provisions on an outer surface of the neck, and at least two radially extending tabs, the fluid pump comprising:

a pump mechanism;

an intake port adapted for fluid communication with liquid contained in the container;

an intake liquid flow path providing fluid communication between the intake port and the pump mechanism;

a discharge port;

a discharge liquid flow path providing fluid communication between the pump mechanism and discharge port;

a closure cap portion configured for releasably securing the fluid pump to the container; and a seal portion engageable with the container and shaped and configured for providing a fluid-tight seal between the fluid pump and the container;

the closure cap portion comprising a generally annular-shaped skirt, at least two lugs extending generally radially inwardly from an inside surface of the skirt and configured to mate with the bayonet provisions of the container when the closure cap portion is positioned on the neck of the container, and at least two apertures in the skirt and circumferentially spaced from the lugs and shaped for receiving the tabs of the container when the closure cap portion is positioned on the neck of the container.

20. A reciprocating fluid pump as set forth in claim 19 wherein:

the skirt has a central skirt axis;

said at least two lugs comprise first and second lugs circumferentially spaced on the skirt and extending generally radially inwardly from the inside surface of the skirt;

said at least two apertures comprise first and second apertures circumferentially spaced on the skirt; and said lugs and apertures being positioned such that a first plane parallel to the skirt axis and intersecting the first and second lugs is generally perpendicular to a second plane parallel to the skirt axis and intersecting the first and second apertures.

* * * * *